US005476171A

United States Patent [19]

Minarelli et al.

[11] Patent Number: 5,476,171

[45] Date of Patent: * Dec. 19, 1995

[54] RIGID HINGED-LID PACKET FOR TOBACCO PRODUCTS, PARTICULARLY CIGARETTES

[75] Inventors: Alessandro Minarelli, Bologna, Italy; Giuseppe Venturi, Richmond, Va.; Roberto Osti, Zola Predosa, Italy

[73] Assignee: G. D Societa' Per Azioni, Bologna, Italy

[ * ] Notice: The portion of the term of this patent subsequent to Nov. 21, 2012, has been disclaimed.

[21] Appl. No.: 196,300

[22] Filed: Feb. 14, 1994

[30] Foreign Application Priority Data

Feb. 17, 1993 [IT] Italy ..... BO93A0049

[51] Int. Cl.[6] ..... B65D 5/50; B65D 85/10

[52] U.S. Cl. ..... 206/256; 206/258

[58] Field of Search ..... 206/242, 248, 206/256, 257, 258, 265, 268

[56] References Cited

U.S. PATENT DOCUMENTS

| | | | |
|---|---|---|---|
| 2,782,788 | 2/1957 | Sholty | 206/256 |
| 3,159,272 | 12/1964 | Swift | 206/256 X |
| 3,858,788 | 1/1975 | Phillips, Jr. | 206/268 X |
| 3,960,270 | 6/1976 | May | 206/256 |
| 4,183,433 | 1/1980 | Kroner | 206/256 X |
| 4,207,976 | 6/1980 | Herman | 206/246 |
| 4,241,827 | 12/1980 | Focke | 206/248 |
| 4,793,478 | 12/1988 | Tudor | 206/256 |

FOREIGN PATENT DOCUMENTS

| | | |
|---|---|---|
| 292567 | 10/1928 | United Kingdom . |
| 411663 | 6/1934 | United Kingdom . |

*Primary Examiner*—Jacob K. Ackun

*Attorney, Agent, or Firm*—Marshall, O'Toole, Gerstein, Murray & Borun

[57] ABSTRACT

A rigid, hinged-lid packet, particularly for cigarettes, wherein a cu-shaped container is closed by a hinged lid and houses a substantially rigid reinforcing structure having a number of seats engaged by respective cigarettes; the reinforcing structure being defined by a number of independent, substantially rigid sleeves, each having a seat for a respective cigarette; and the sleeves contacting one another, and being made integral with one another and with the container.

6 Claims, 2 Drawing Sheets

RIGID HINGED-LID PACKET FOR TOBACCO PRODUCTS, PARTICULARLY CIGARETTES

BACKGROUND OF THE INVENTION

The present invention relates to a rigid, hinged-lid packet for tobacco products, particularly cigarettes.

Known rigid, hinged-lid cigarette packets are normally designed to house an orderly group of cigarettes arranged in two or three rows, flush with one another, and packed tightly together against the walls of the packet.

Such an arrangement invariably poses a number of problems for removing the first few cigarettes from the packet. In particular, any external stress applied to the packet is transmitted to the cigarettes which, being arranged contacting one another, transmit the stress from one to the other thus resulting in tobacco fallout. Moreover, when the packet is partly emptied, the cigarettes no longer occupy a definite position inside the packet, and tend to roll against one another, again resulting in tobacco fallout.

SUMMARY OF THE INVENTION

It is an object of the present invention to provide a rigid, hinged-lid packet designed to overcome the aforementioned drawbacks.

According to the present invention, there is provided a rigid, hinged-lid packet for tobacco products, particularly cigarettes, comprising a cup-shaped container; a lid hinged to the container and movable between an open position and a closed position wherein it closes the container; and a substantially rigid reinforcing structure housed inside the container and defining a number of seats for respective said products; characterized by the fact that said reinforcing structure comprises a number of independent, substantially rigid sleeves, each having a central hole defining a respective said seat for a respective said product; said sleeves contacting and being made integral with one another.

According to a preferred embodiment of the above packet, the packet is longer by a given amount as compared with the products; the sleeves are arranged inside the container in a front row and a rear row; and each sleeve in the rear row presents, inside the respective said seat, supporting means for offsetting the respective said product axially in relation to a corresponding product in the front row.

Moreover, the lid preferably presents stop means for maintaining a given axial position of the products in the front row.

BRIEF DESCRIPTION OF THE DRAWINGS

A non-limiting embodiment of the present invention will be described by way of example with reference to the accompanying drawings, in which.

DETAILED DESCRIPTION OF TEE INVENTION

Figure 1:
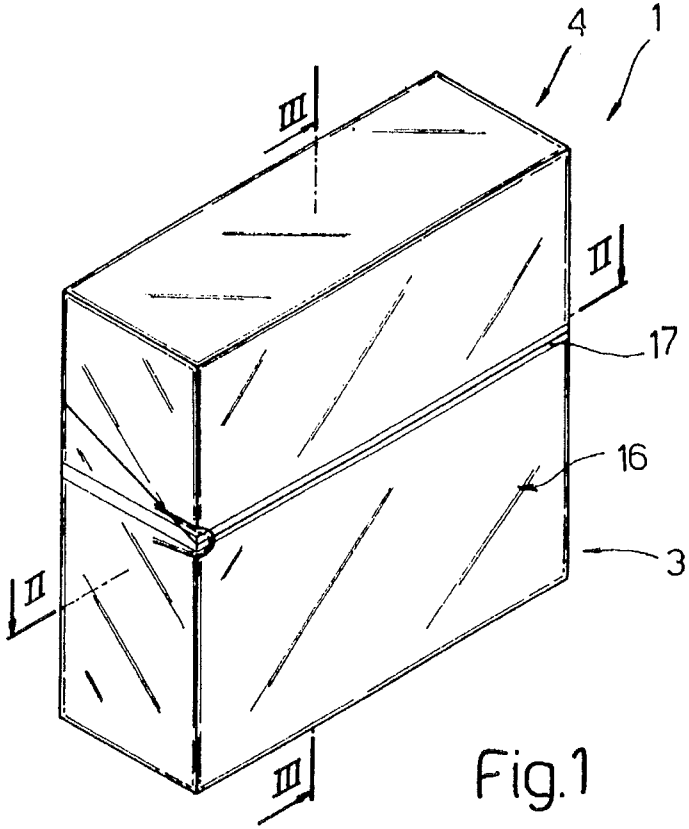
FIG. 1 shows a view in perspective of a preferred embodiment of the packet according to the present invention.
Figure 4:
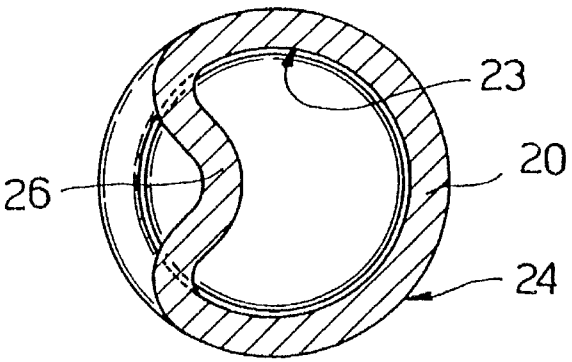
FIG. 4 shows a section along line IV—IV in FIG. 3.

Number 1 in FIG. 1 indicates a rigid, hinged-lid packet for an orderly group of cigarettes 2, and comprising a cup-shaped bottom container 3, and a cup-shaped top lid 4 connected to container 3 so as to rotate between an open position and a closed position wherein it closes container 3.

Container 3 presents a front wall 5 and rear wall 6 parallel to and facing each other; two parallel lateral walls 7 perpendicular to walls 5 and 6; and a bottom wall 8 perpendicular to walls 5, 6 and 7. Wall 5 is shorter than wall 6, so that walls 7 are defined at the top by edges sloping downwards towards wall 5.

Lid 4 presents a front wall 9 and a rear wall 10 parallel to and facing each other; two parallel lateral walls 11 perpendicular to walls 9 and 10; and a top wall 12 perpendicular to walls 9, 10 and 11. Wall 9 presents an inner strengthening flap 13, the end portion of which is bent perpendicularly inwards of packet 1 to form a tab 14 parallel to and located a given distance from wall 12. Wall 10 presents a bottom edge connected by hinge 15 to the top edge of wall 6, and is shorter than wall 9, so that walls 11 are defined at the bottom by edges sloping downwards towards wall 9.

As shown in FIG. 1, packet 1 is completed outwards by a wrapping 16 of transparent material divisible into two parts by means of a tear-off strip 17, and inwards by a known substantially U-shaped collar (not shown) extending upwards from the open end of container 3 and engaging lid 4 when this is closed.

Figure 2:
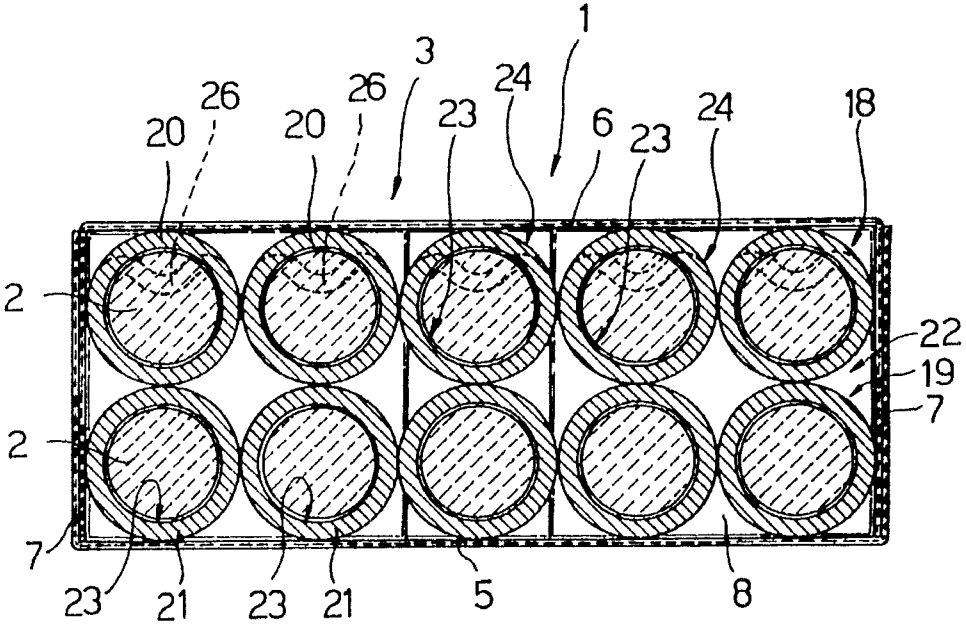
FIG. 2 shows, with parts removed for clarity, a larger-scale section along line II—II in FIG. 1.
Figure 3:
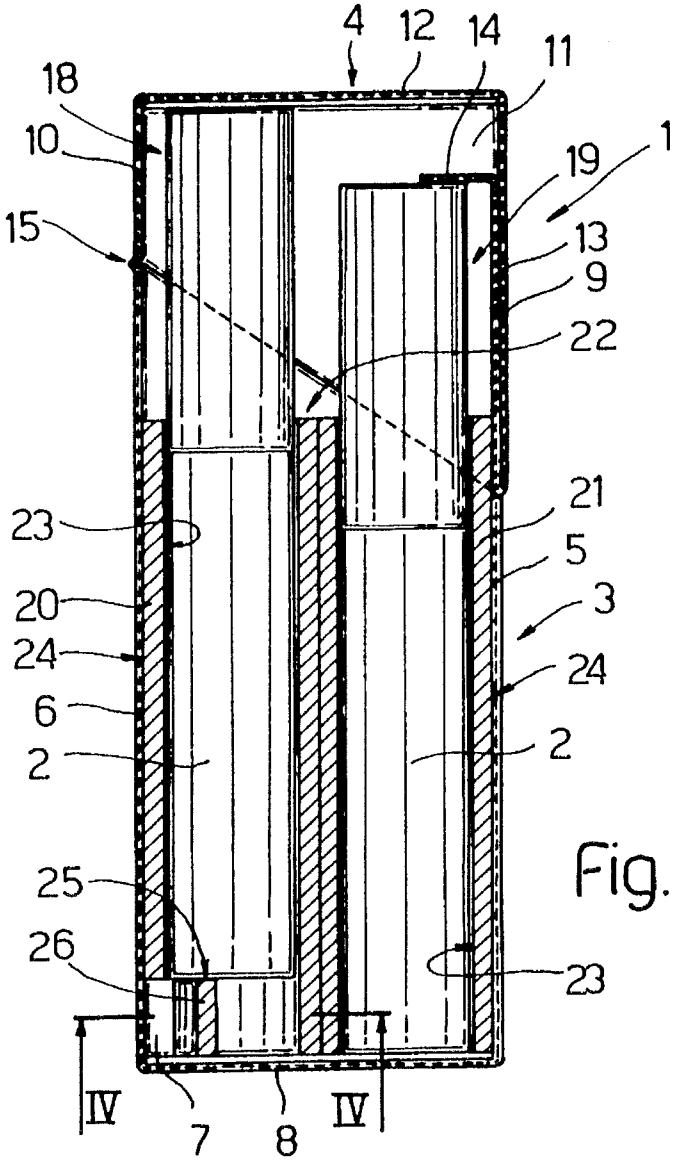
FIG. 3 shows, with parts removed for clarity, a larger-scale section along line III—III in FIG. 1.

As shown in FIGS. 2 and 3, inside container 3, cigarettes 2 are arranged in two parallel rows 18 and 19 between walls 5 and 6, and each cigarette 2 in one row 18, 19 is aligned, in a direction perpendicular to walls 5 and 6, with a corresponding cigarette 2 in the other row.

Cigarettes 2 in rows 18 and 19 are housed partially inside respective independent sleeves 20 and 21 preferably made of plastic material, and made integral with the adjacent sleeves 20 and 21. and preferably with the inner surface of container 3, either by friction or bonding, so as to form a substantially rigid reinforcing structure 22 inside container 3.

As shown in FIG. 2, each sleeve 20, 21 presents a cylindrical central hole 23 constituting a seat for housing in sliding manner the end portion of a respective cigarette 2; and is defined externally by a surface 24 coaxial with respective hole 23. In the embodiment shown, surface 24 is a cylindrical surface tangent to surfaces 24 of adjacent sleeves 20 and 21, but may of course be replaced by any surface having a plane cross section inscribable in a square with sides equal in length to the diameter of surface 24, perpendicular to one another, and respectively parallel to walls 5, 6 and 7.

Sleeves 20 and 21 are equal in length, shorter than cigarettes 2, and substantially the same length as wall 5, so that cigarettes 2 project outwards of the open top end of container 3. More specifically, cigarettes 2 are shorter than packet 1, and cigarettes 2 in front row 19 substantially contacting wall 5 are arranged with the bottom end contacting the inner surface of wall 8, and the top end contacting the bottom surface of tab 14; while cigarettes 2 in rear row 18 substantially contacting wall 6 are arranged with the top end substantially contacting the inner surface of wall 12, and the bottom end contacting a respective shoulder 25 formed by partially cutting respective sleeve 20 transversely, close to the bottom end, and pushing the cut portion inwards to form a curved portion 26 penetrating partly inside respective hole 23 and defining respective shoulder 25.

Reinforcing structure 22 consisting of sleeves 20 and 21 thus provides for maintaining cigarettes 2 firmly in position inside packet 1; for preventing external stress on the packet during use, and particularly during storage, from being transmitted to the cigarettes; for preventing direct contact of the cigarettes and hence the transmission of forces resulting in tobacco fallout; and, last but not least, for enabling arrangement of the cigarettes in vertically offset rows for trouble-free removal from the packet.

Another important point to note is that, by virtue of structure 22 keeping cigarettes 2 separate, holes 23 may also be used for replacing cigarette ends, particularly the filters, to prevent littering.

We claim:

1. A rigid, hinged-lid packet for cigarettes, comprising a cup-shaped container;

a lid hinged to the container and movable between an open position and a closed position wherein said lid closes the container;

and a substantially rigid reinforcing structure housed inside the container and defining a number of seats for respective said cigarettes;

said reinforcing structure comprising a number of independent, substantially rigid sleeves, each having a central hole defining a respective said seat for a respective said cigarette;

the sleeves being arranged inside the container in a front row and a rear row; each sleeve in the rear row having internal supporting means for axially offsetting a respective cigarette in relation to a corresponding cigarette, in a front row;

and each said supporting means comprising a portion of the respective said sleeve, cut and folded inwards of the respective said seat.

2. A packet as claimed in claim 1, wherein said sleeves are made integral with the container.

3. A packet as claimed in claim 1, wherein each sleeve is defined externally by a surface having a cross section ranging between a circle of a given diameter and a square circumscribing said circle.

4. A packet as claimed in claim 1, wherein said lid includes stop means for maintaining a given axial, position of the cigarettes in said front row.

5. A packet as claimed in claim 4, wherein said lid includes a front wall having an inner strengthening flap; an end portion of the strengthening flap being bent perpendicularly and projecting inwards to define said stop means.

6. A packet as claimed in claim 1, wherein said sleeves (20, 21) contact and are integral with one another.

* * * * *

UNITED STATES PATENT AND TRADEMARK OFFICE

CERTIFICATE OF CORRECTION

PATENT NO. : 5,476,171

DATED : December 19, 1995

INVENTOR(S) : Alessandro Minarelli, et al.

It is certified that error appears in the above-indentified patent and that said Letters Patent is hereby corrected as shown below:

On the title page item [*] Notice:

Change "subsequent to Nov. 21, 2012," to

--subsequent to Feb. 15, 2014,--

Signed and Sealed this

Thirtieth Day of April, 1996

*Attest:*

*Attesting Officer*

BRUCE LEHMAN

*Commissioner of Patents and Trademarks*